US010249425B2

(12) United States Patent
Kobayashi

(10) Patent No.: US 10,249,425 B2
(45) Date of Patent: Apr. 2, 2019

(54) COIL DEVICE

(71) Applicant: TDK CORPORATION, Tokyo (JP)

(72) Inventor: Katsumi Kobayashi, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 15/628,950

(22) Filed: Jun. 21, 2017

(65) Prior Publication Data

US 2017/0372827 A1 Dec. 28, 2017

(30) Foreign Application Priority Data

Jun. 27, 2016 (JP) ..... 2016-126906

(51) Int. Cl.

| | |
|---|---|
| ***H01F 17/04*** | (2006.01) |
| ***H01F 5/04*** | (2006.01) |
| ***H01Q 1/20*** | (2006.01) |
| ***H01Q 1/32*** | (2006.01) |
| ***H01F 5/02*** | (2006.01) |
| ***H01F 27/02*** | (2006.01) |
| ***H01F 27/26*** | (2006.01) |
| ***H01Q 1/40*** | (2006.01) |
| ***H01Q 7/08*** | (2006.01) |

(52) U.S. Cl.

CPC ..... *H01F 17/04* (2013.01); *H01F 5/02* (2013.01); *H01F 5/04* (2013.01); *H01F 27/022* (2013.01); *H01F 27/266* (2013.01); *H01Q 1/20* (2013.01); *H01Q 1/3208* (2013.01); *H01Q 1/405* (2013.01); *H01Q 7/08* (2013.01)

(58) Field of Classification Search

CPC .. H01F 17/04; H01F 5/04; H01Q 1/20; H01Q 1/3208

See application file for complete search history.

(56) References Cited

U.S. PATENT DOCUMENTS 7,095,381 B2 * 8/2006 Kimura ..... H01Q 1/3241 343/788

FOREIGN PATENT DOCUMENTS

JP 2014-175363 A 9/2014

* cited by examiner

*Primary Examiner* — Graham P Smith
(74) *Attorney, Agent, or Firm* — Oliff PLC

(57) ABSTRACT

A coil device includes a core member, a bobbin, a coil portion, an outer case, and a potting resin. The core member extends in a longitudinal direction. The bobbin is provided with a longitudinal concave portion communicating with a side surface opening portion open to outside and housing the core member. The coil portion is provided with a wire wound around the bobbin. The outer case is provided with a housing concave portion configured to house the bobbin housing the core member and have the coil portion. The potting resin is filled in the housing concave portion and surrounds the bobbin with the coil portion. An opening port of the housing concave portion and the side surface opening portion are open in the same direction.

16 Claims, 13 Drawing Sheets

COIL DEVICE

BACKGROUND OF THE INVENTION

1. Field of the Invention

The present invention relates to a coil device as an antenna, for example.

2. Description of the Related Art

To protect a coil device used for antennas from impact including vibration, it is considered to house a bobbin with a coil portion in an outer case and seal around the coil device with a potting resin or so. The entire periphery of the bobbin is preferably sealed with resin in the outer case. Thus, as shown in Patent Document 1, a convex portion is arranged on an outer periphery of the bobbin to be sealed with resin and abuts against an inner wall of the outer case, and a space between the bobbin and the outer case is arranged so that a sealing resin reaches the space, for example.

However, the bobbin is constituted by a hard epoxy resin and surrounds the entire periphery of four side surfaces of a core member, and the core member tends to move in the bobbin and collide with an inner wall of the bobbin and may decrease impact resistance characteristics. High-level impact resistance characteristics are required particularly for coil devices used in auto industry or so, and sufficient impact resistance characteristics are hard to be obtained by a conventional coil device structure.

Patent Document 1: JP 2014-175363A

SUMMARY OF THE INVENTION

The present invention has been achieved under such circumstances. It is an object of the invention to provide a coil device excellent in impact resistance characteristics.

To achieve the above object, the coil device according to the present invention is a coil device including:

a core member extending in a longitudinal direction; a bobbin with a longitudinal concave portion communicating with a side surface opening portion open to outside and housing the core member;

a coil portion with a wire wound around the bobbin;

an outer case with a housing concave portion configured to house the bobbin housing the core member and have the coil portion; and a potting resin filled in the housing concave portion and surrounding the bobbin with the coil portion, wherein an opening port of the housing concave portion and the side surface opening portion are open in the same direction.

In the coil device of the present invention, the bobbin does not cover four side surfaces of the core member extending in the longitudinal direction, but has the side surface opening portion so that a surface whose area is the largest of the four side surfaces is open toward outside the bobbin. Thus, when the potting resin is injected from the opening port of the housing concave portion of the outer case into the outer case, the potting resin enters the bobbin from the side surface opening portion and surrounds the core member. In particular, the outer side surface of the core member facing the side surface opening portion is covered with the potting resin having a sufficiently large volume without being disturbed by the outer wall of the bobbin. Thus, even if the coil device receives an impact, the core member does not collide with the inner wall of the bobbin by moving inside the bobbin, and impact resistance characteristics are improved.

Since the opening port of the housing concave portion and the side surface opening portion are open in the same direction, the potting resin injected from the opening port of the housing concave portion easily enters the bobbin from the side surface opening portion. In addition, the outer side surface of the core member facing the side surface opening portion faces a free interface of the potting resin stored in the housing concave portion, and is thus covered with the potting resin whose volume is larger than any other outer side surface of the core member, and impact resistance characteristics are improved. Incidentally, the free interface is an outer surface of the potting resin and is a contact surface with the air not covered with the outer case. The distance between the free inter face and the outer side surface of the core member facing the side surface opening portion can be controlled by the amount of the potting resin to be filled in the housing concave portion.

An easily deformable member may be arrange between an outer wall of the bobbin and a bottom wall of the housing concave portion, and the easily deformable member is capable of being deformed before the bobbin and the outer case are deformed when the outer case receives an impact. In this case, the bobbin touches the bottom wall of the outer case via the easily deformable member being more deformable than the bobbin itself.

When the outer case receives an impact, the easily deformable member is easily deformed elastically or plastically (may be broken), and the impact transmitted to the outer case is weakened and transmitted to the bobbin. The potting resin is filled in the space between the bobbin and the outer case. The potting resin has a sufficiently low longitudinal elasticity, and can thus effectively absorb an impact applied to the outer case in cooperation with the easily deformable member.

Thus, impact resistance characteristics are improved, compared to conventional coil devices where a convex portion formed on a bobbin (having a similar deformation strength to that of the bobbin) touches a bottom wall of an outer case. Thus, it is possible to further reduce an impact applied to a core member arranged inside the bobbin (by a drop test or so).

The easily deformable member may be formed integrally with the bobbin or the outer case, and for example, may be an oblique leg integrally formed with a part of the bobbin or the outer case. When the easily deformable member is formed integrally with the bobbin or the outer case, there is no need to separately prepare an easily deformable member, which contributes to reduction in the number of components.

A window portion going through inside and outside of the bobbin may be formed on the outer wall of the bobbin positioned on the opposite side to the side surface opening portion formed in the bobbin. When the window portion is formed, the potting resin enters the bobbin from the window portion as well. A plurality of the window portions may be formed intermittently along the longitudinal direction.

The easily deformable member, such as the oblique leg, may be formed in the window portion. When a plate member or a linear portion is formed integrally from a window edge of the window portion and protrudes obliquely toward a bottom surface of the bobbin at a predetermined angle, the plate member or the linear portion is easily deformed and can favorably function as the easily deformable member.

The bobbin may be provided with a first pressing portion protruding from a part of an inner surface of the outer wall toward the longitudinal concave portion. The first pressing portion may lift the core member from the inner surface of the outer wall and enable the potting resin to enter the space.

The side surface opening portion may be provided with a second pressing portion preventing a positional displacement of the core member from a predetermined position of the longitudinal concave portion. In this configuration, the core member is positioned against the bobbin with the coil portion, a positional displacement of the core member against the coil portion is prevented, and the characteristic deviation as coil can be prevented.

The side surface opening portion may be provided with a convex portion preventing the core member from abutting on the coil portion via the side surface opening portion. In this configuration, even if the core member moves toward the side surface opening portion, the convex portion can disturb and prevent the core member from colliding with the coil portion.

Preferably, an end of the bobbin in the longitudinal direction may be provided with a core insertion port communicating with the longitudinal concave portion. After the coil portion is formed around an outer circumference of the outer wall of the bobbin, the core member can be inserted from the core insertion port into the bobbin.

The core insertion port may be provided with one of a claw portion and a caulking portion preventing the core member housed in the longitudinal concave portion from coming out therefrom. In this configuration, the core member can be effectively prevented from moving toward the bobbin along the longitudinal direction in a state before the potting resin is filled in the housing concave portion of the outer case.

DESCRIPTION OF THE PREFERRED EMBODIMENTS

Figure 1A:
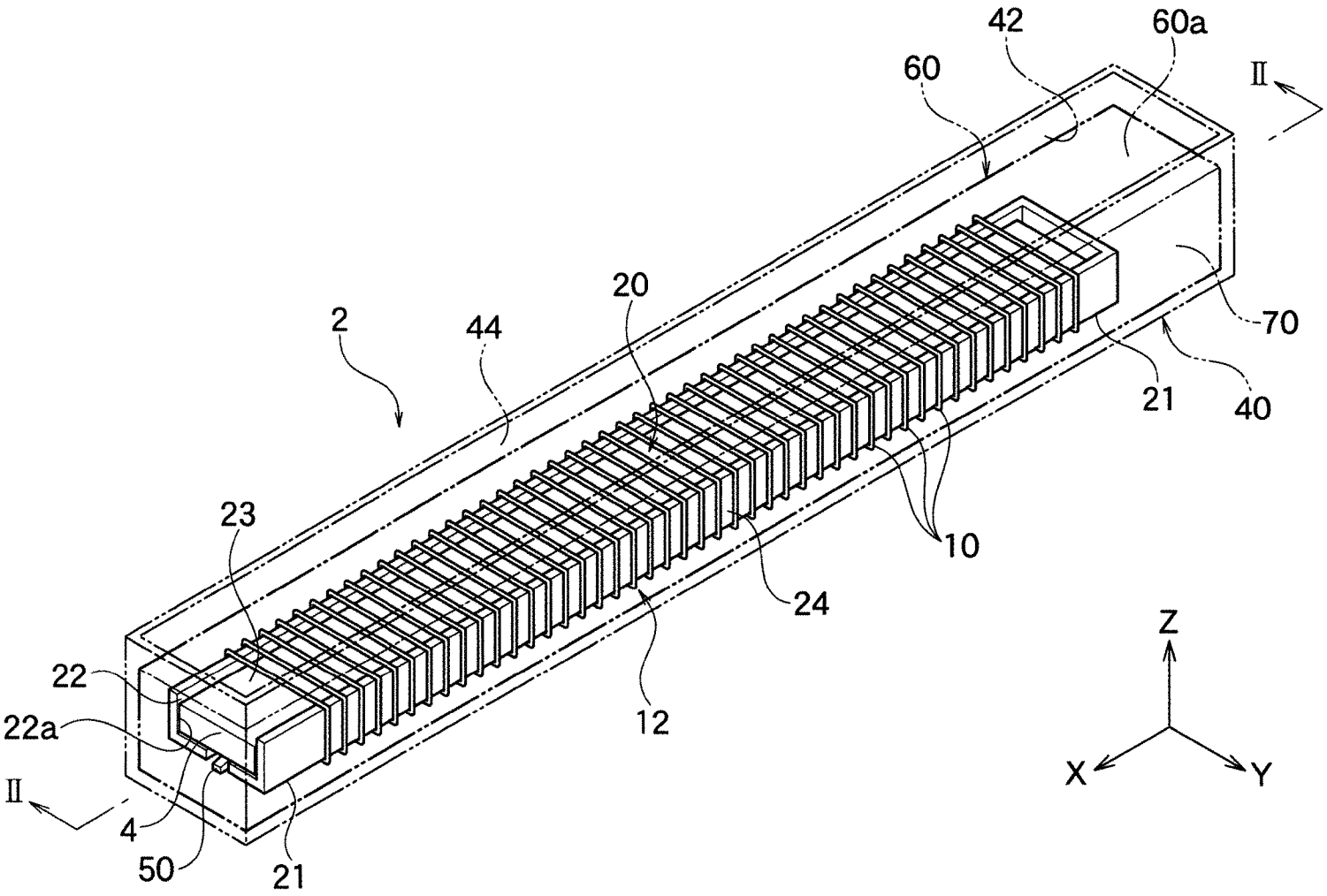
FIG. 1A is a partially transparent perspective view of a coil device according to an embodiment of the present invention.

Hereinafter, the present invention will be described based on embodiments shown in the figures.

First Embodiment

A coil device 2 according to First Embodiment of the present invention shown in FIG. 1A to FIG. 3B is used as an antenna device for automobiles mounted inside a doorknob or so, a coil for antenna included in a doorknob or so of housing like an apartment, or the like. The coil device 2 has a flat core member 4 that is long in the X-axis direction, is thin in the Z-axis direction, and is wide in the Y-axis direction. Incidentally, the X-axis, the Y-axis, and the Z-axis are vertical to each other in the figures.

The core member 4 has any size, and has a length of 30 to 120 mm in the X-axis direction, a width of 5 to 20 mm in the Y-axis direction, and a thickness of 1 to 10 mm in the Z-axis direction, for example. In the present embodiment, the core member 4 is constituted by a single core member extending in the X-axis direction, but may be constituted by a plurality of core members divided and simply arranged in the X-axis direction in the bobbin 20, or may be constituted by joining these core members using an adhesive.

For example, the core member 4 may be constituted by a magnetic body, such as ferrite, metal magnetic body, permalloy, and pressed powder, or by a nonmagnetic body, such as alumina and ceramic. The core member 4 is preferably constituted by a magnetic body material whose relative permeability $\mu$ is preferably 1000 or more, more preferably 3000 or more, and particularly preferably 5000 or more. The core member 4 normally has a longitudinal elasticity of 100000 to 160000 MPa.

The core member 4 is configured to be arranged in a longitudinal concave portion 22 in the X-axis direction formed in the bobbin 20. The longitudinal concave portion 22 of the bobbin 20 has a shape covering three side surfaces of the core member 4. The bobbin 20 has a side surface opening portion 23 extending in the X-axis direction so that a surface whose area is the largest of four side surfaces of the core member 4 is open toward outside the bobbin 20.

Figure 1B:
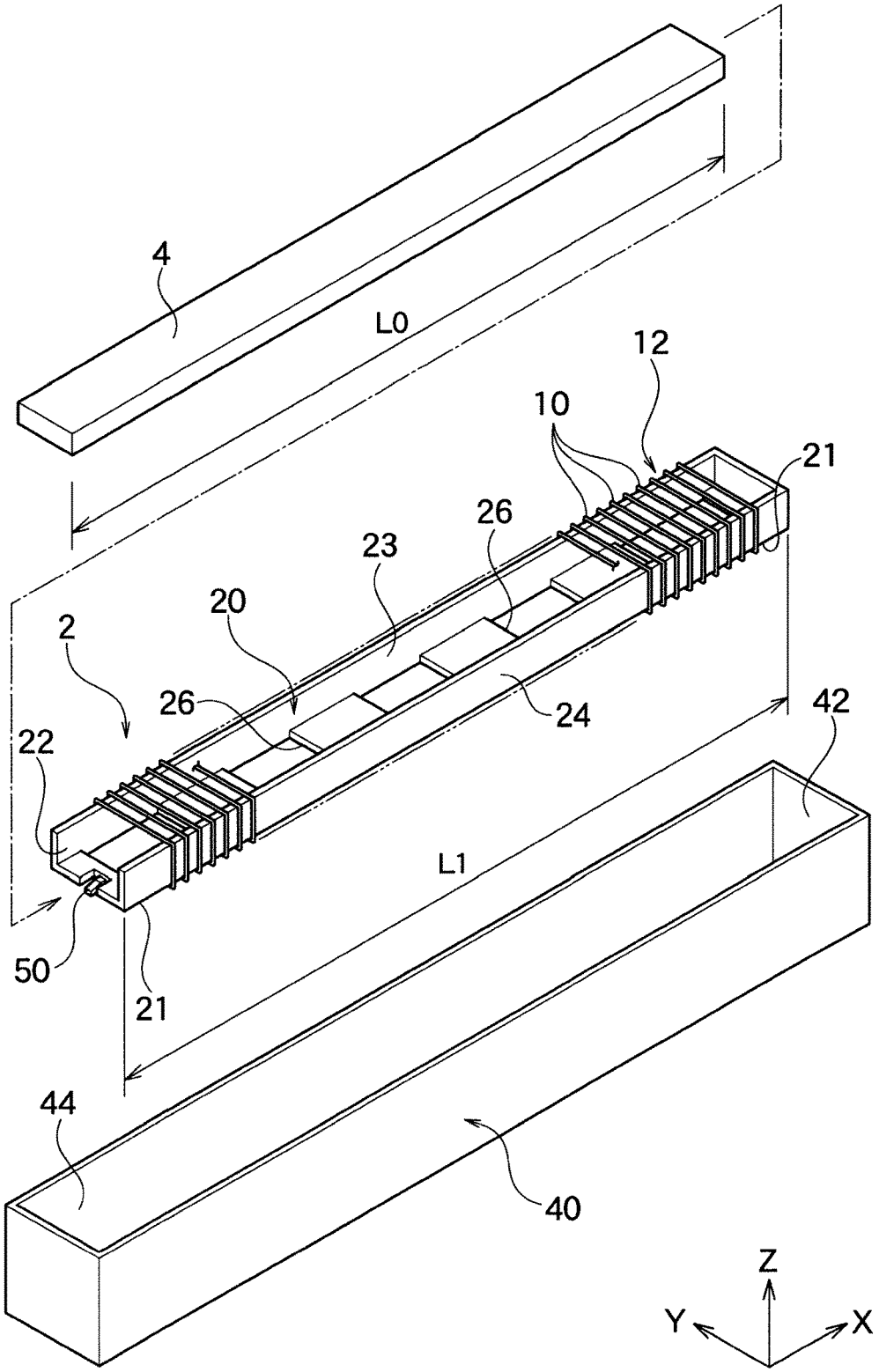
FIG. 1B is a disassembled perspective view of the coil device shown in FIG. 1A.

As shown in FIG. 1B, L1/L0 is determined to be 0.6 to 1.3, where L1 is a length of the bobbin 20 in the X-axis direction, and L0 is an axial length of the core member 4. That is, the core member 4 may protrude from the X-axis direction end of bobbin 20, or may be housed completely in the bobbin 20. Preferably, most of the core member 4 is configured to be housed in the longitudinal concave portion 22 of the bobbin 20, and at least the core member 4 is configured to be positioned in the bobbin 20 where a coil portion 12 wound by a wire 10 is formed around the outer peripheral portion of the bobbin 20.

The single (or multiple) wire 10 is spirally wound around the outer wall 24 of the bobbin 20 in the X-axis direction so as to form the coil portion 12. The wire 10 may be any wire, such as resin coated wire and twisted wire. The wire 10 has any diameter, but preferably has 50 to 500 μm.

Both ends of the wire 10 forming the coil portion 12 are connected to various kinds of electronic components arranged in a component case housed in an electronic component housing portion 70 shown in FIG. 1A. The various kinds of electronic components include a resistor, a capacitor, and the like, needed as antenna devices. The electronic component housing portion 70 is formed at one of end positions in the X-axis direction of the bobbin 20 in a housing concave portion 42 of an outer case 40. The housing portion 70 has any length in the X-axis direction, but has about 1/10 to 1/2 of the length L1 of the bobbin 20 in the X-axis direction (see FIG. 1B).

As shown in FIG. 1B, a singular or plurality of window portions 26 communicating inside and outside of the bobbin 20 is formed along the X-axis direction on the lower surface of the outer wall 24 of the bobbin 20 in the Z-axis direction. In the present embodiment, the upper surface of the outer wall 24 of the bobbin 20 is a side surface opening portion 23, and the longitudinal concave portion 22 whose three side surfaces are surrounded by the outer wall 24 is communicated with outside of the bobbin 20 via the side surface opening portion 23. The side surface opening portion 23 and the window portion 26 are formed on the side surfaces of the bobbin 20 opposite to each other in the Z-axis direction.

For example, the bobbin 20 is formed by injection molding, and is constituted by a synthetic resin of PBT, PET, nylon, LCP, PPS, phenol, or the like. The bobbin 20 has a longitudinal elasticity of 1000 to 20000 MPa.

The outer case 40 has the housing concave portion 42 configured to house the bobbin 20 housing the core member 4 and have the coil portion 12 around the outer wall 24. An upper part of the outer case 40 in the Z-axis direction is provided with an opening port 44 so that the upper part of the housing concave portion 42 in the Z-axis direction is open. The housing concave portion 42 is large enough to house the bobbin 20 surrounded by the potting resin 60. That is, the housing concave portion 42 has a depth D0 in the Z-axis direction (see FIG. 2) that is 1.3 times to 2 times larger than a height of the bobbin 20 in the Z-axis direction.

The potting resin 60 has a filling depth D1 that is 0.5 times to 1 time larger than the depth D0 of the housing concave portion 42 in the Z-axis direction. The filling depth D1 of the potting resin 60 is preferably 1.1 times to 1.5 times larger than a height of the bobbin 20 in the Z-axis direction. The filling depth D1 of the potting resin 60 corresponds to a height in the Z-axis direction from a bottom surface of the housing concave portion 42 of the outer case 40 to a free interface 60*a* of the potting resin 60. Incidentally, the free interface 60*a* is an outer surface of the potting resin 60*a* and is a contact surface with the air not covered with the outer case 40.

For example, the outer case 40 is formed by injection molding, and is constituted by a synthetic resin of PBT, PET, nylon, LCP, PPS, phenol, or the like. The outer case 40 has a longitudinal elasticity of 8000 to 10000 MPa, which is the same as or different from a longitudinal elasticity of the bobbin 20.

The potting resin 60 filled in the housing concave portion 42 of the outer case 40 is composed of a silicone resin, a urethane resin, an epoxy resin, or the like, that is still soft after the filling, and preferably has a longitudinal elasticity of 0.1 to 100 MPa. The potting resin 60 is filled not only around the bobbin 20 with the coil portion 12, but also a space between the bobbin 20 and the core member 4 and in a space between the bobbin 20 and the inner wall surface of the outer case 40. The potting resin 60 is injected from the upper part of the opening port 44 of the housing concave portion 42 of the outer case 40.

In the present embodiment, a plurality of oblique legs (easily deformable members) 50 is formed integrally with the bobbin 20 on both ends in the X-axis direction of a bottom outer surface 21 of the bobbin 20. In the present embodiment, the oblique leg 50 is formed on both ends of the bobbin 20 in the X-axis direction. Each of the oblique legs 50 is inclined toward the bottom outer surface 21 of the bobbin 20 at a predetermined angle θ. The predetermined angle θ is preferably 60 to 30 degrees, more preferably 45 to 20 degrees.

The oblique legs 50 touch the bottom inner surface 41 of the outer case 40 in the outer case 40 before the potting resin 60 is injected or while the potting resin 60 is being injected, and leave a space between the lower surface of the bobbin 20 and the bottom inner surface 41 of the outer case 40 so that the potting resin 60 reaches the space easily.

Figure 3A:
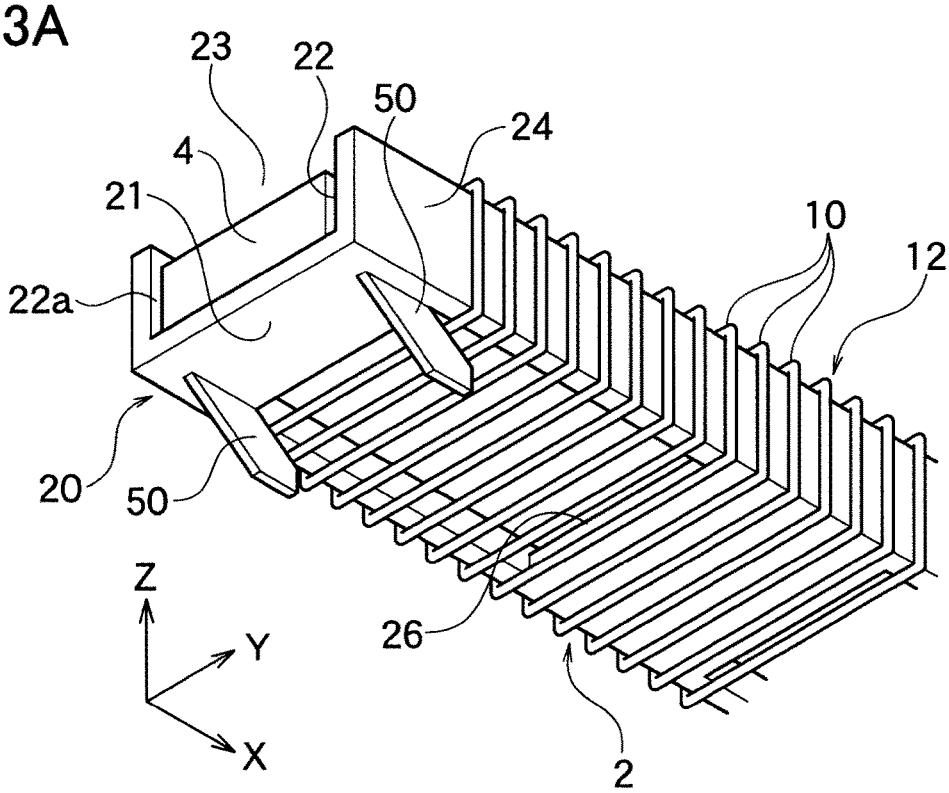
FIG. 3A is a partial perspective view of a bobbin of the coil device shown in FIG. 1B.

In the present embodiment, the oblique legs 50 are formed integrally with the bobbin 20 and are constituted by a plate piece directed toward outside the bobbin 20 in the X-axis direction, but is not limited thereto. For example, as shown in FIG. 3A, the oblique legs 50 may be a plane plate piece parallel to the X-axis and the Z-axis, and the number of the oblique legs 50 is not limited. The oblique legs 50 shown in FIG. 3A are constituted by a plate piece directed toward inside the bobbin 20 in the X-axis direction. The oblique legs 50 do not necessarily have a linear plate shape, and may have a curved surface plate shape.

Figure 3B:
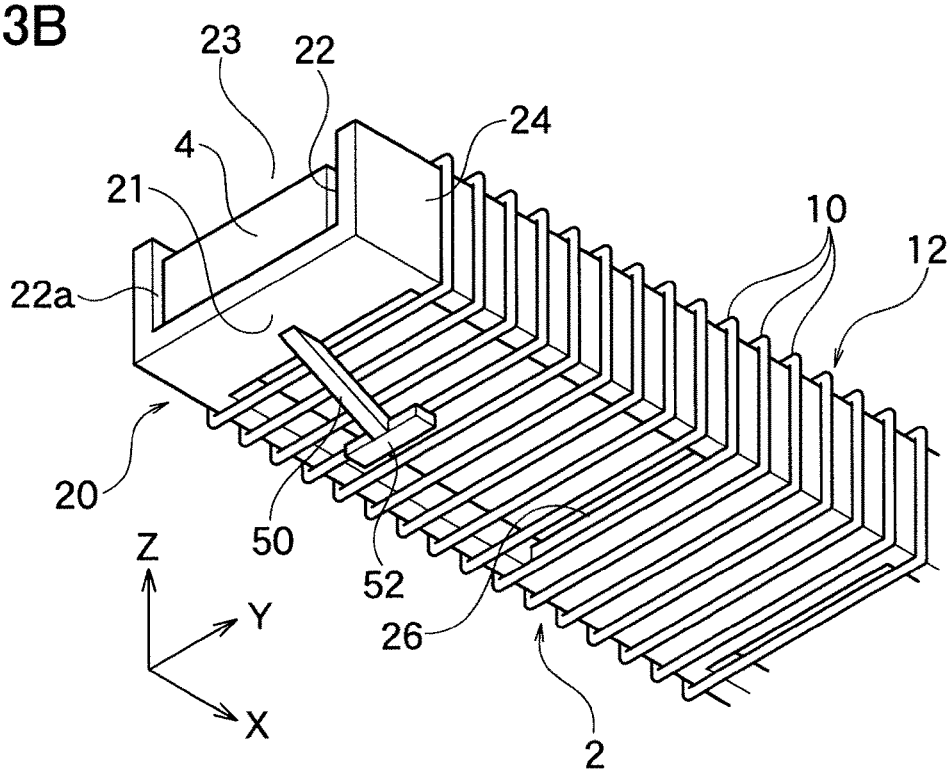
FIG. 3B is a partial perspective view of a bobbin according to a variation of FIG. 3A.

Furthermore, as shown in FIG. 3B, the oblique legs 50 may be a linear member whose tip is provided with an abutting member 52. The abutting member 52 is configured to be in surface contact with the bottom inner surface 41 of the outer case 40. The linear member is deformed more easily than the plate member.

The oblique plate leg 50 may be formed in the window portion 26. When the plate leg 50 is formed integrally from the opening edge of the window portion 26 and protrudes obliquely toward the bottom surface of the bobbin 20 at a predetermined angle θ, the plate leg 50 is easily deformed and can favorably function as the easily deformable member.

Figure 2:
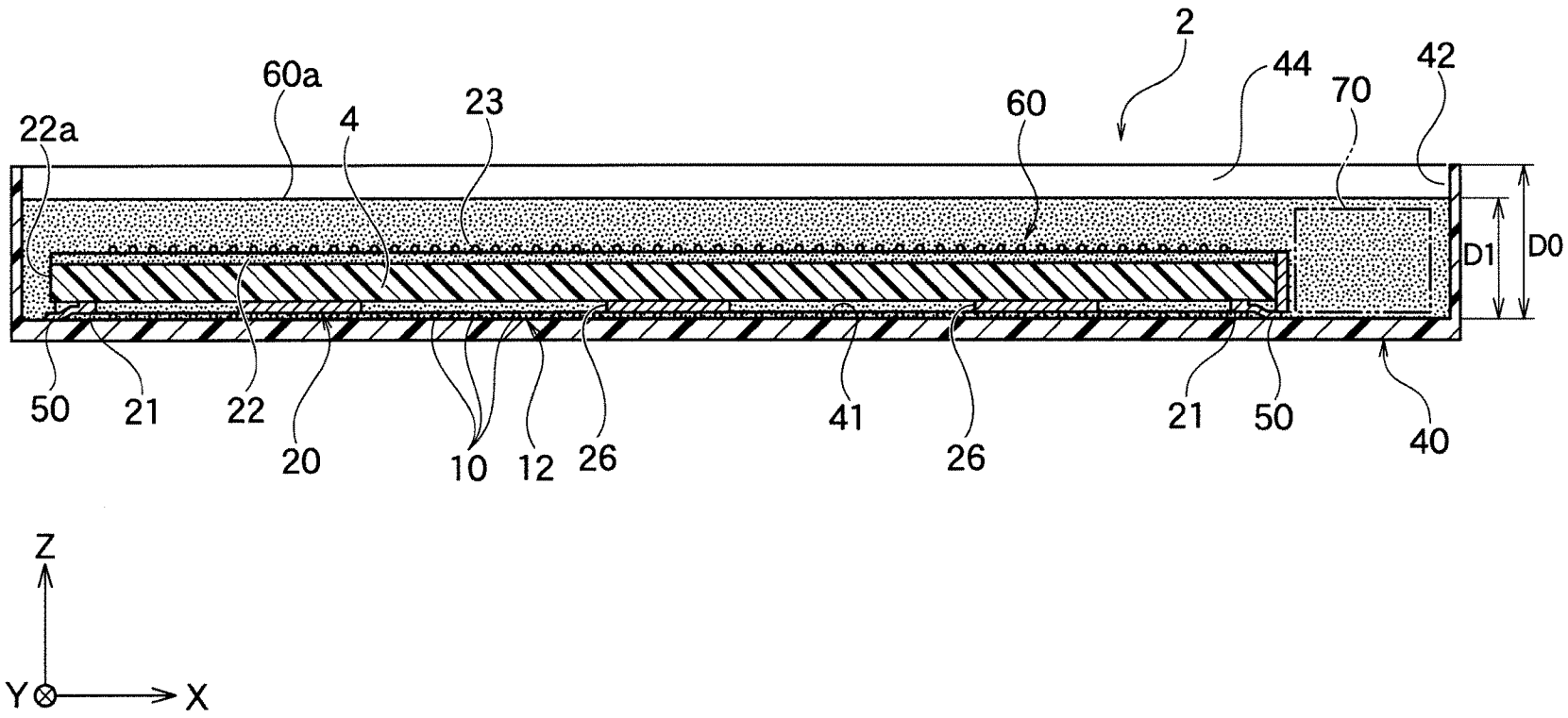
FIG. 2 is a cross sectional view along the II-II line of the coil device shown in FIG. 1A.

As shown in FIG. 2, the oblique legs 50 are at least interpositioned between the bottom outer surface 21 of the bobbin 20 and the bottom inner surface 41 of the outer case 40, but may be additionally formed on a side surface of the bobbin 20 in the Y-axis direction. In this case, the bobbin 20 can be positioned not only in the Z-axis direction but in the Y-axis direction in the outer case 40, and it is thus expected to buffer not only an impact in the Z-axis direction applied to the bobbin 20 and the core member 4 but an impact in the Y-axis direction applied to the bobbin 20 and the core member 4.

In the present embodiment, the bobbin 20 touches the inner bottom wall of the outer case 40 in the outer case 40 via the oblique legs 50 as easily deformable members. When the outer case 40 receives an impact, the oblique legs 50 are deformed before the bobbin 20 and the outer case 40 are deformed. That is, when the outer case 40 receives an impact, the oblique legs 50 are easily deformed elastically or plastically (may be broken), and the impact transmitted to the outer case 40 is weakened and transmitted to the bobbin 20.

The potting resin 60 is filled in the space between the bobbin 20 and the outer case 40. The potting resin 60 has a sufficiently low longitudinal elasticity, and can thus effectively absorb an impact applied to the outer case 40 in cooperation with the oblique legs 50. In the present embodiment, the oblique legs 50 are formed integrally with the bobbin 20, and there is thus no need to separately prepare an easily deformable member, which contributes to reduction in the number of components.

In particular, in the present embodiment, the bobbin 20 does not cover four side surfaces of the core member 4 extending in the X-axis direction, but has the side surface opening portion 23 so that a surface whose area is the largest of the four side surfaces is open toward outside the bobbin 20. Thus, when the potting resin 60 is injected from the opening port 44 of the housing concave portion 42 of the outer case 40 into the outer case 40, the potting resin 60 enters the bobbin 20 from the side surface opening portion 23 via the spaces of the wire 10 and surrounds the core member 4.

In particular, the outer side surface of the core member 4 facing the side surface opening portion 23 is covered with the potting resin 60 having a sufficiently large volume without being disturbed by the outer wall 24 of the bobbin 20. Thus, even if the coil device 2 receives an impact, the core member 4 does not collide with the inner wall of the bobbin 20 by moving inside the bobbin 20, and impact resistance characteristics are improved.

Since the opening port 44 of the housing concave portion 42 of the outer case 40 and the side surface opening portion 23 of the bobbin 20 are open in the same direction, the potting resin 60 injected from the opening port 44 of the housing concave portion 42 easily enters the bobbin 20 from the side surface opening portion 23. In addition, the outer side surface of the core member 4 facing the side surface opening portion 23 faces the free interface 60*a* of the potting resin 60 stored in the housing concave portion 42, and is thus covered with the potting resin 60 whose volume is larger than any other outer side surface of the core member 4, and impact resistance characteristics are improved. Incidentally, the distance between the free inter face 60*a* and the outer side surface of the core member 4 facing the side surface opening portion 23 can be controlled by the amount of the potting resin 60 to be filled in the housing concave portion 42.

In the present embodiment, the window portions 26 going through inside and outside of the bobbin 20 are formed on the outer wall of the bobbin 20 positioned on the opposite side in the Z-axis direction to the side surface opening portion 23 formed in the bobbin 20. When the window portions 26 are formed, the potting resin 60 enters the bobbin 20 from the window portions 26 as well, impact resistance characteristics are improved, and the breakage of the core member 4 or so can be further effectively prevented.

In the present embodiment, a core insertion port 22*a* communicating with the longitudinal concave portion 22 is formed in an end of the bobbin 20 in the X-axis direction. After the coil portion 12 is formed by winding the wire 12 around the outer circumference of the outer wall 24 of the bobbin 20, the core member 4 can be inserted from the core insertion port 22*a* into the bobbin 20. Thereafter, the bobbin 20 into which the core member 4 is inserted is arranged inside the outer case 40 via the opening port 44. Thereafter, the potting resin 60 is inserted from the opening port 44 into the outer case 40.

Second Embodiment

Figure 4A:
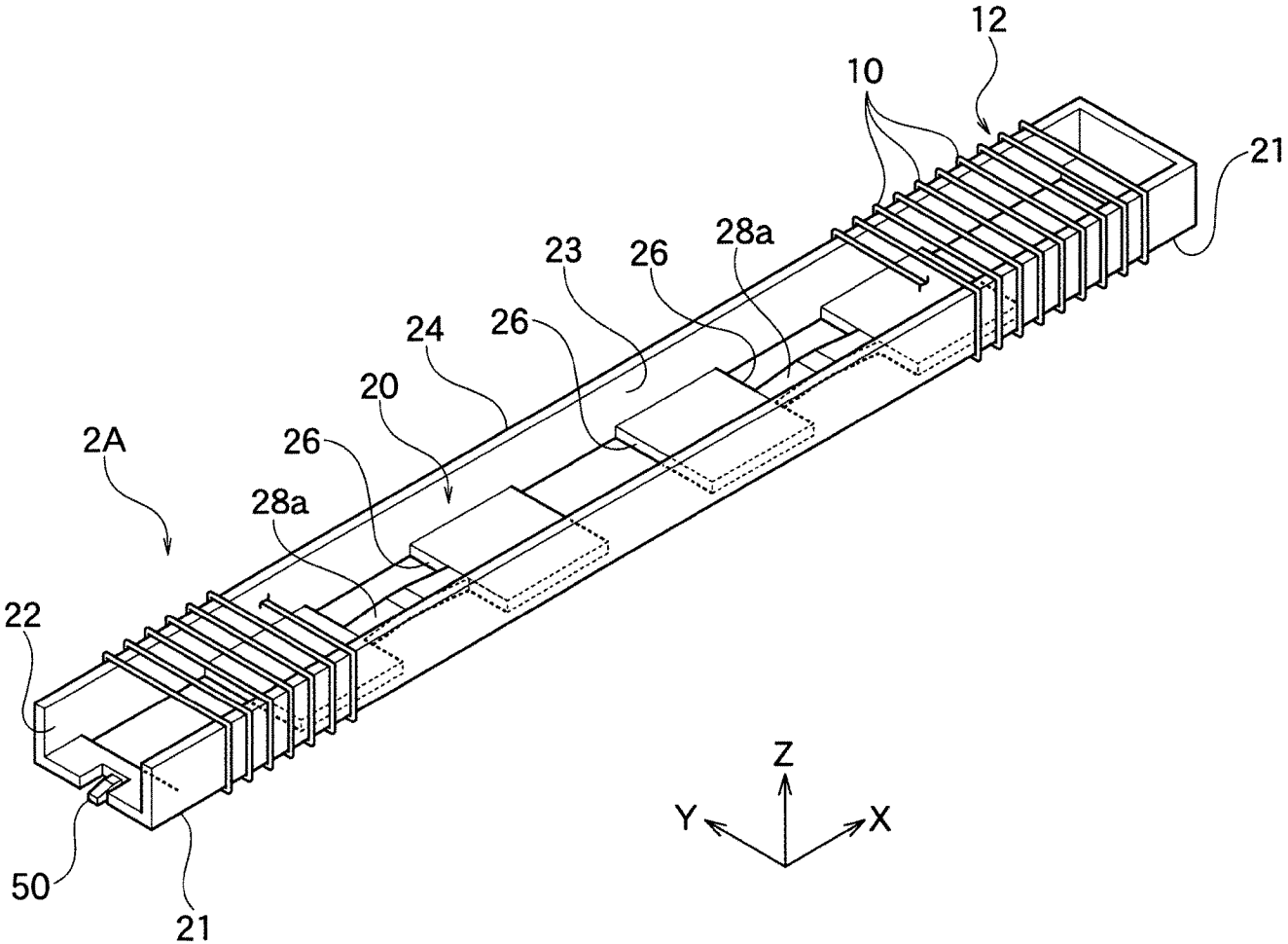
FIG. 4A is a perspective view of a bobbin according to a variation of the coil device shown in FIG. 1A.

A coil device 2A of the present embodiment shown in FIG. 4A is different from the coil device 2 of First Embodiment only in the following matters, and overlapping matters will not be explained as the other features and effects are the same.

Figure 4B:
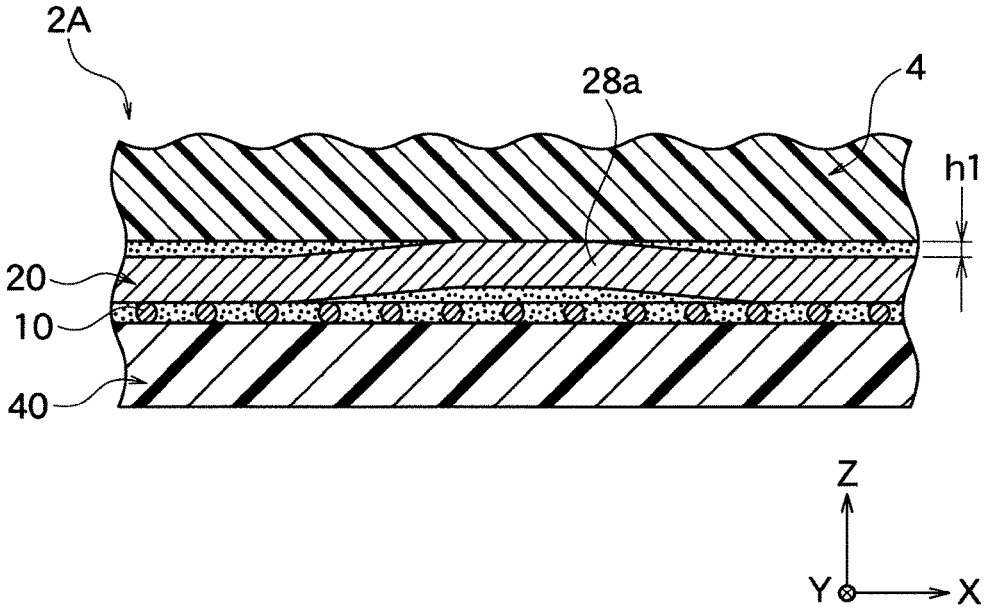
FIG. 4B is a cross sectional view of a main part showing a relation among the bobbin, an outer case, and a core member shown in FIG. 4A.

In the present embodiment, the window portions 26 of the bobbin 20 are provided with a pressing piece 28*a* as a first pressing portion protruding from the bottom outer surface 21 of the outer wall 24 of the bobbin 20 toward the longitudinal concave portion 22. As shown in FIG. 4B, the pressing pieces 28*a* lift the bottom surface of the core member 4 from the bottom inner surface of the bobbin 20 with a predetermined height h1, and a potting resin enters this space. The predetermined height h1 is not limited, but is preferably 0.1 to 1.0 mm.

As shown in FIG. 4A, the pressing pieces 28*a* are constituted by an arc piece connecting an opening edge of the window portion 26 in the X-axis direction with an upward convex shape at the middle part of the opening portion 26 in the Y-axis direction. The pressing pieces 28*a* have a width in the Y-axis direction that is smaller than a width of the window portions 26 in the Y-axis direction. Both sides of the pressing piece 28 do not shut the window portion 26.

Incidentally, the pressing pieces 28*a* may have a width in the Y-axis direction that is equal to a width of the window portions 26 in the Y-axis direction. Even in this case, the pressing pieces 28 protrude downward in the Z-axis direction from the inner surface of the outer wall 24, and slits are formed on both sides of the pressing piece 28 in the Y-axis direction. The slits function as openings for communicating inside and outside of the outer wall 24, but the pressing pieces 28 do not need to be formed by corresponding to the window portions 26, and may be formed in a part of the outer peripheral wall 24 where no window portion 26 is formed.

In the present embodiment, the pressing pieces 28 are formed on only the outer wall 24 positioned on the lower surface in the Z-axis direction, and are in contact with the lower surface of the core member 4 in the Z-axis direction by spring force. Thus, the lower surface of the core member 4 in the Z-axis direction is lifted from the bottom inner surface of the outer wall 24 of the bobbin 20, and a potting resin enters the space.

Figure 4C:
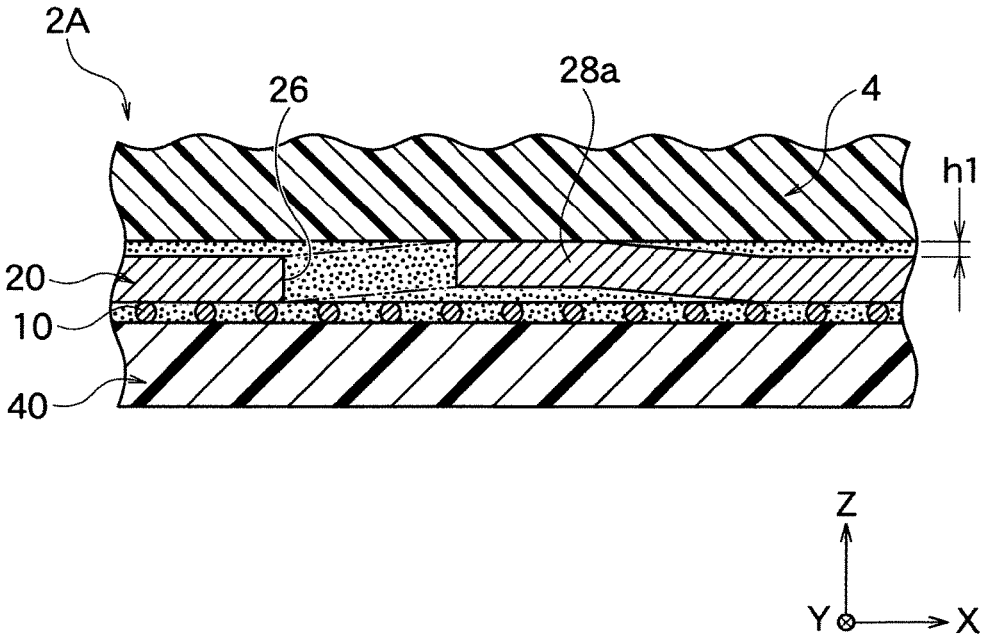
FIG. 4C is a cross sectional view of a main part showing a variation of the bobbin shown in FIG. 4B.

Incidentally, the pressing pieces 28*a* do not need to be constituted by an arc piece connecting an opening edge of the window portion 26 in the X-axis direction with an upward convex shape, and as shown in FIG. 4C, may be a cantilever semi-arc piece 28*a* connected to an opening edge of the window portion 26 in the X-axis direction.

Third Embodiment

Figure 5A:
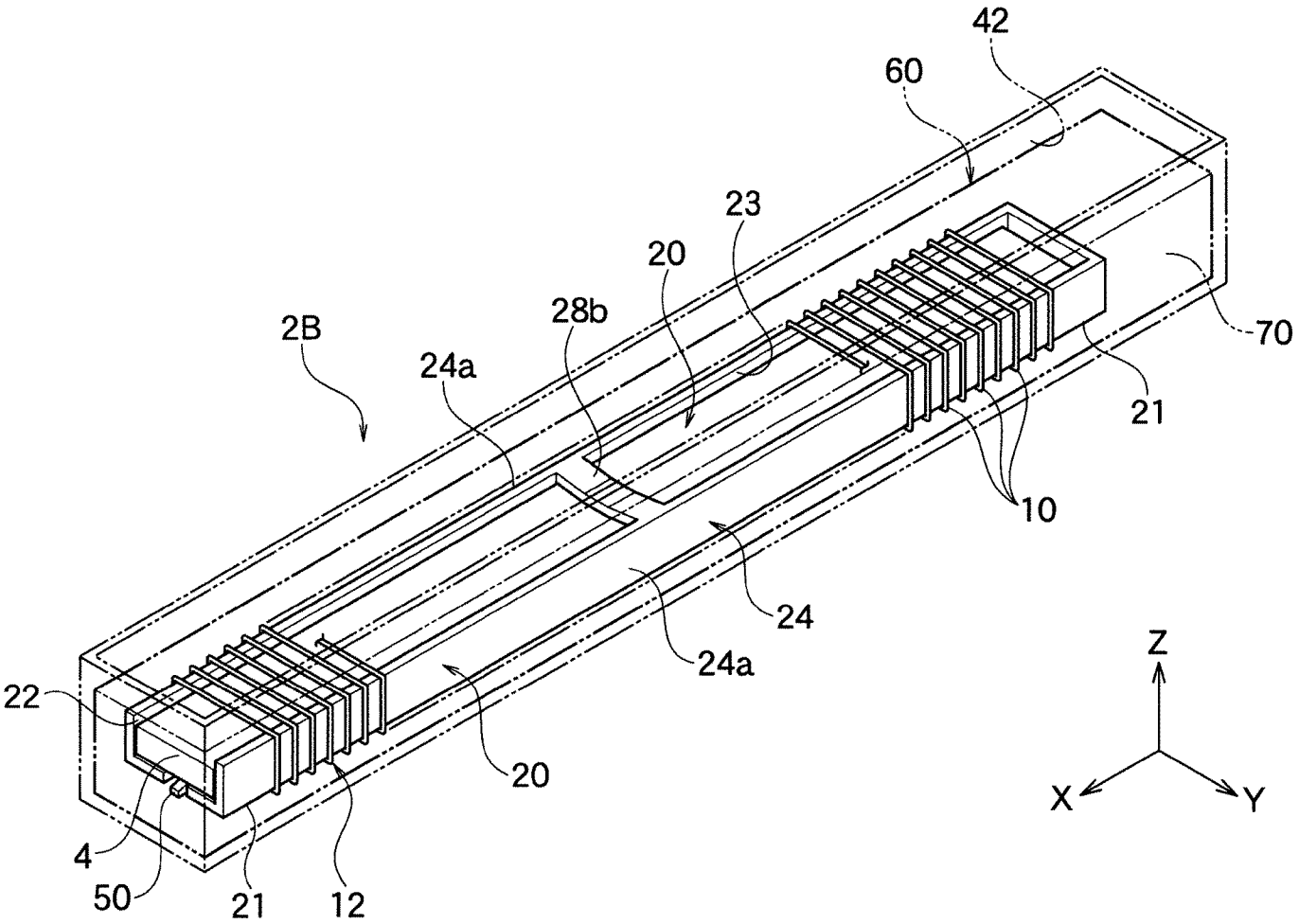
FIG. 5A is a partially transparent perspective view according to a variation of the coil device shown in FIG. 1A.

As shown in FIG. 5A, a coil device 2B of the present embodiment is different from the coil device 2 of First Embodiment or the coil device 2A of Second Embodiment only in the following matters, and overlapping matters will not be explained as the other features and effects are the same.

In the present embodiment, a pressing piece (second pressing piece) 28*b* extending in the Y-axis direction is formed in an approximately middle part of the side surface opening portion 23 in the X-axis direction formed on the upper surface of the bobbin 20 in the Z-axis direction so that upper ends of side walls 24*a* of the outer wall 24 are communicated with each other. The middle part of the pressing piece 28*b* in the Y-axis direction is curved toward the longitudinal concave portion 22 in a downward convex shape (arc shape) and can press the upper surface of the core member 4 downwardly in the Z-axis direction.

Thus, the lower surface of the core member 4 in the Z-axis direction is pressed against the bottom inner surface of the outer wall 24 constituting the longitudinal concave portion 22 of the bobbin 20. As a result, the core member 4 is prevented from moving inside the bobbin 20 in the X-axis direction (the same applies to the Y-axis direction and the Z-axis direction) before a potting resin 60 mentioned below is filled or even while the potting resin 60 is being filled into the outer case 40.

Incidentally, when providing the outer wall 24 with the pressing piece 28*a* as the first pressing portion protruding upward from the bottom outer surface 21 toward the longitudinal concave portion 22 in the Z-axis direction, the core member 4 is positioned in the longitudinal concave portion 22 of the bobbin 20 by being sandwiched between the pressing pieces 28*a* and 28*b* located above and below in the Z-axis direction. The second pressing portion is not limited to the pressing piece 28*b* shown in FIG. 5A, and may be a pressing piece 28*b*1 shown in FIG. 5B.

Figure 5B:
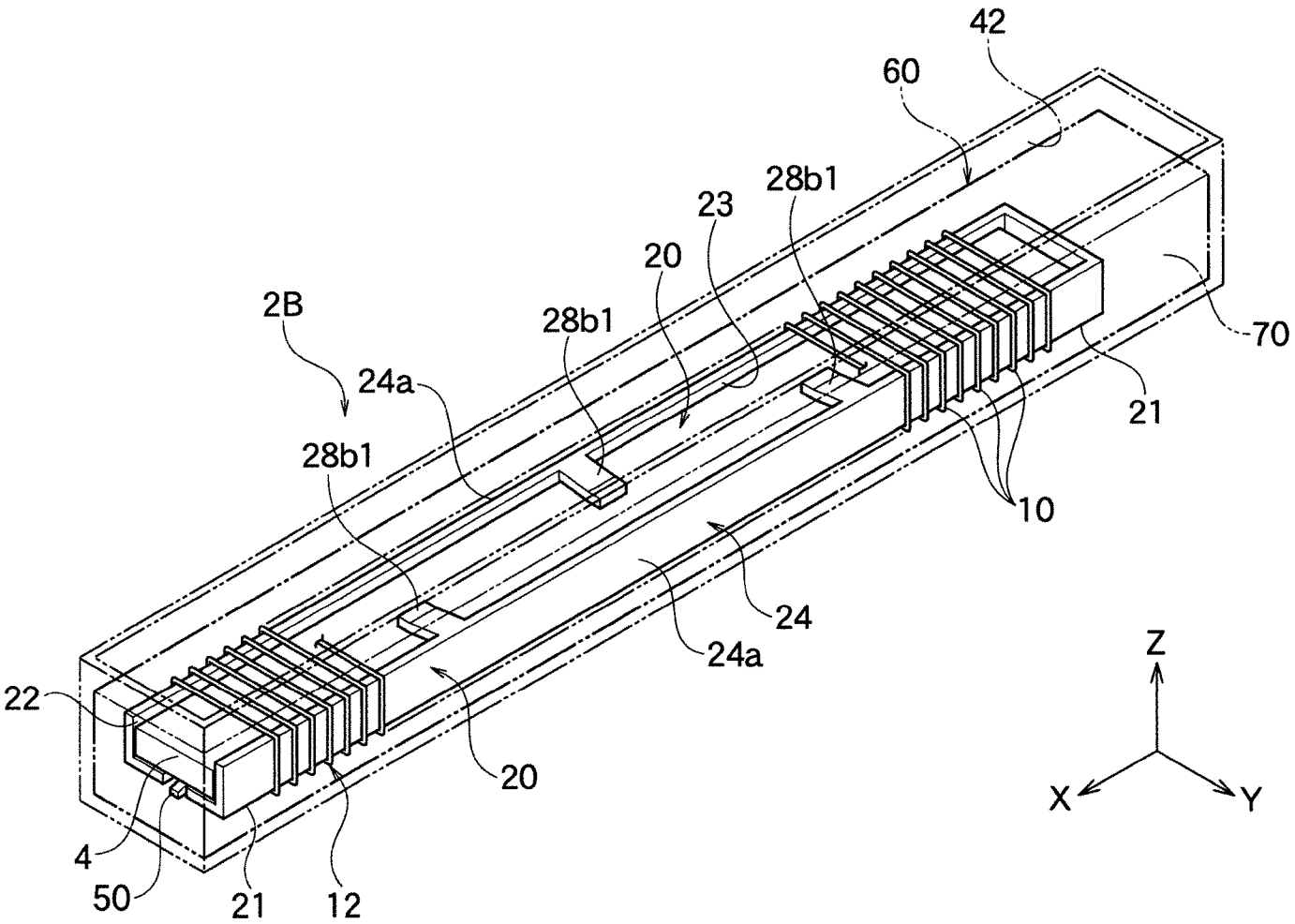
FIG. 5B is a partially transparent perspective view according to a variation of the coil device shown in FIG. 5A.

Unlike the pressing piece 28*b* shown in FIG. 5A, the pressing pieces 28*b*1 shown in FIG. 5B do not connect upper ends of a pair of the side walls 24*a* in the Z-axis direction and are formed in a cantilever manner at either of the side walls 24*a*, and tips of the pressing pieces 28*b*1 downwardly press the upper surface of the core member 4. The pressing pieces 28*b*1 are formed alternately from either of the side walls 24*a* along the X-axis direction.

The pressing piece 28*b* or 28*b*1 as the second pressing piece can position the core member 4 against the bobbin 20 by touching the core member 4 and pressing it downwardly in the Z-axis direction. In this way, the core member 4 is positioned against the bobbin 20 with the coil portion 12, a positional displacement of the core member 4 against the coil portion 12 is prevented, and the characteristic deviation as antenna coil can be prevented.

The pressing piece 28*b* or 28*b*1 can prevent the core member 4 from colliding with the wire 10 constituting the coil portion 12 in the side surface opening portion 23. In the present embodiment, a part of the side surface opening portion 23 is closed by the pressing piece 28*b* or 28*b*1, and only an extremely small area of the side surface opening portion 23 is closed. The area of the side surface opening portion 23 closed by the pressing piece 28*b* or 28*b*1 is 20% or less of the entire area of the side surface opening portion 23.

Fourth Embodiment

Figure 6:
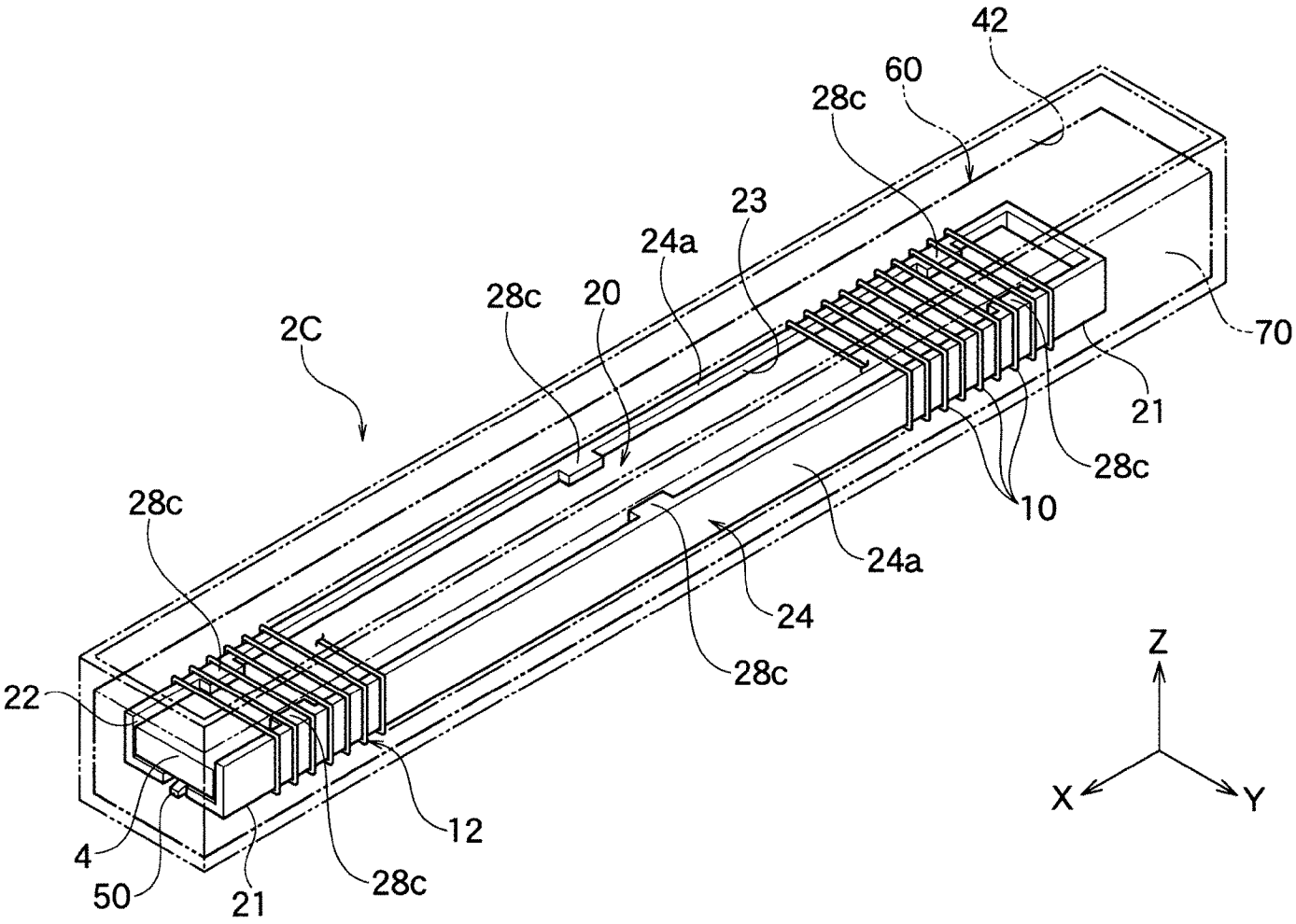
FIG. 6 is a partially transparent perspective view according to a variation of the coil device shown in FIG. 1A.

As shown in FIG. 6, a coil device 2C of the present embodiment is different from the coil device 2B of Third Embodiment only in the following matters, and overlapping matters will not be explained as the other features and effects are the same.

In the present embodiment, the side surface opening portion 23 is provided with convex portions 28*c* preventing the core member 4 from abutting on the wire 10 of the coil portion 12 via the side surface opening portion 23. The convex portions 28*c* do not need to touch the upper surface of the core member 4 in the Z-axis direction. In this configuration, even if the core member 4 moves toward the side surface opening portion 23, the convex portions 28 can disturb and prevent the core member 4 from colliding with the wire 10 of the coil portion 12. Incidentally, as with the pressing piece 28*b* or 28*b*1, the convex portions 28*c* formed in the side surface opening portion 23 close only an extremely small area of the side surface opening portion 23. The area ratio of the side surface opening portion 23 closed by the convex portions 28*c* is similar to that of the pressing piece 28*b* or 28*b*1.

Fifth Embodiment

Figure 7A:
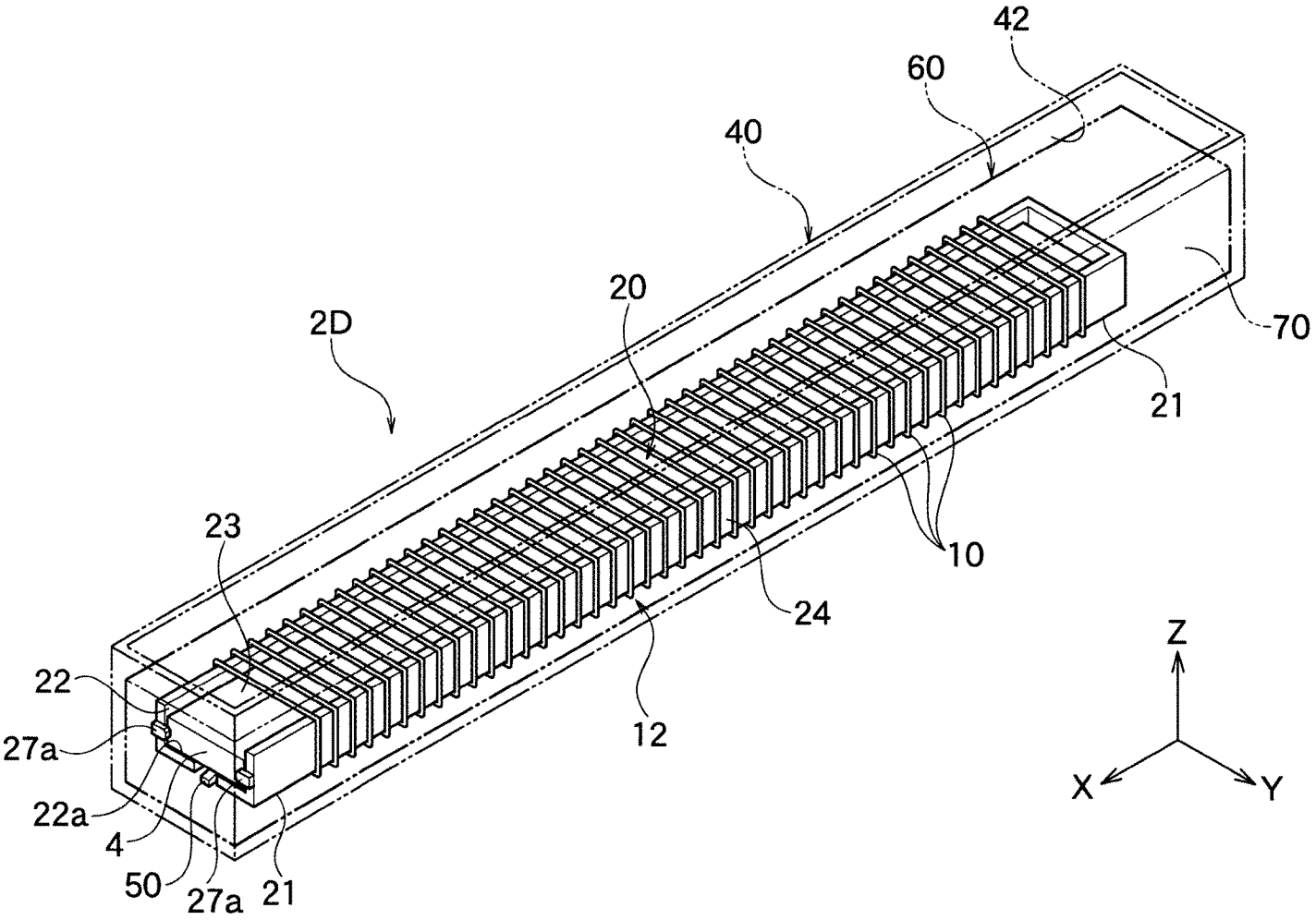
FIG. 7A is a partially transparent perspective view according to a variation of the coil device shown in FIG. 1A.

As shown in FIG. 7A, a coil device 2D of the present embodiment is different from the coil devices of First Embodiment to Fourth Embodiment only in the following matters, and overlapping matters will not be explained as the other features and effects are the same.

Figure 7B:
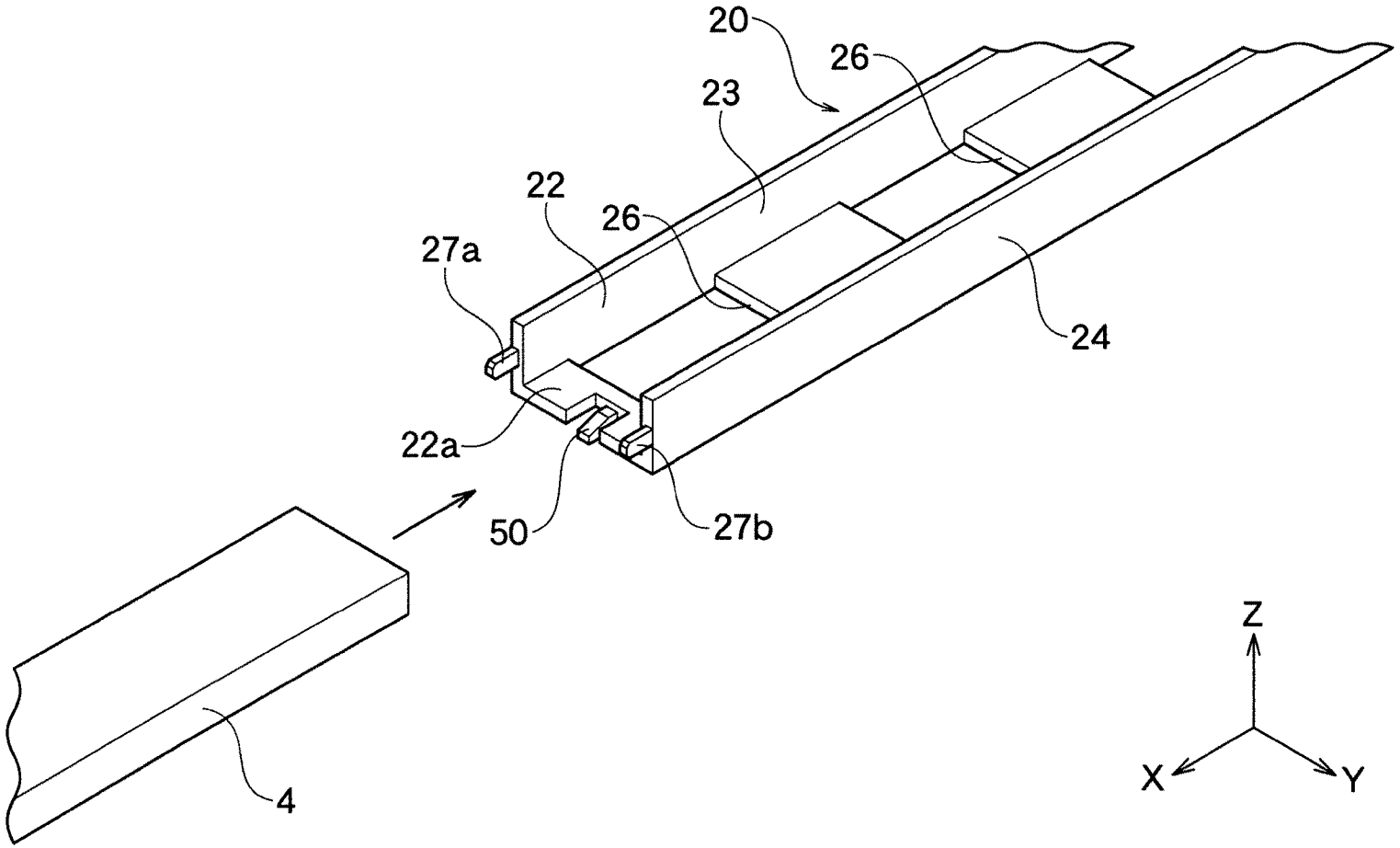
FIG. 7B is a disassembled perspective view of a main part showing a relation between a bobbin and a core member shown in FIG. 7A.

In the coil device 2D of the present embodiment, the core insertion port 22*a* is provided with caulking portions 27*a* preventing the core member 4 contained in the longitudinal concave portion 22 from coming out from the insertion port 22*a* in the X-axis direction. As shown in FIG. 7B, the caulking portions 27*a* are integrally formed near the insertion port 22*a* of the outer wall 24 so that the core insertion port 22*a* is not closed when the core member 4 is inserted from the insertion port 22*a* of the bobbin 20. When the caulking portions 27*a* are pressed (and heated) after the core member 4 is inserted from the insertion port 22*a* along the X-axis direction, as shown in FIG. 7A, a part of the insertion port 22*a* is closed, and the core member 4 is prevented from coming out from the insertion port 22*a* in the X-axis direction. Incidentally, FIG. 7B does not illustrate a coil portion wound around the bobbin 20.

In the present embodiment, the core member 4 can be effectively prevented from moving toward the bobbin 20 along the X-axis direction in a state before the potting resin 60 shown in FIG. 7A is filled in the housing concave portion 42 of the outer case 40.

Figure 8A:
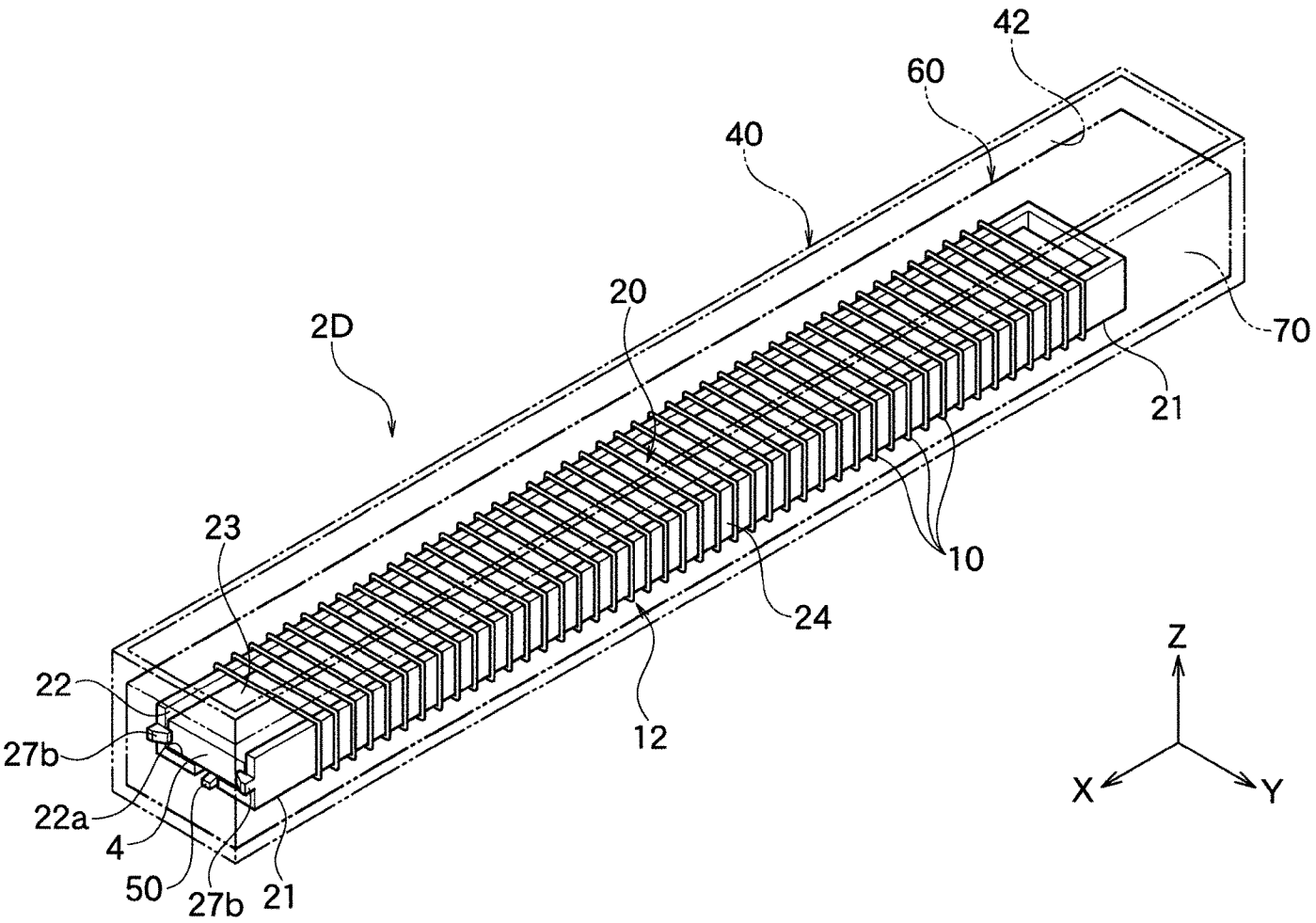
FIG. 8A is a partially transparent perspective view according to a variation of the coil device shown in FIG. 1A.
Figure 8B:
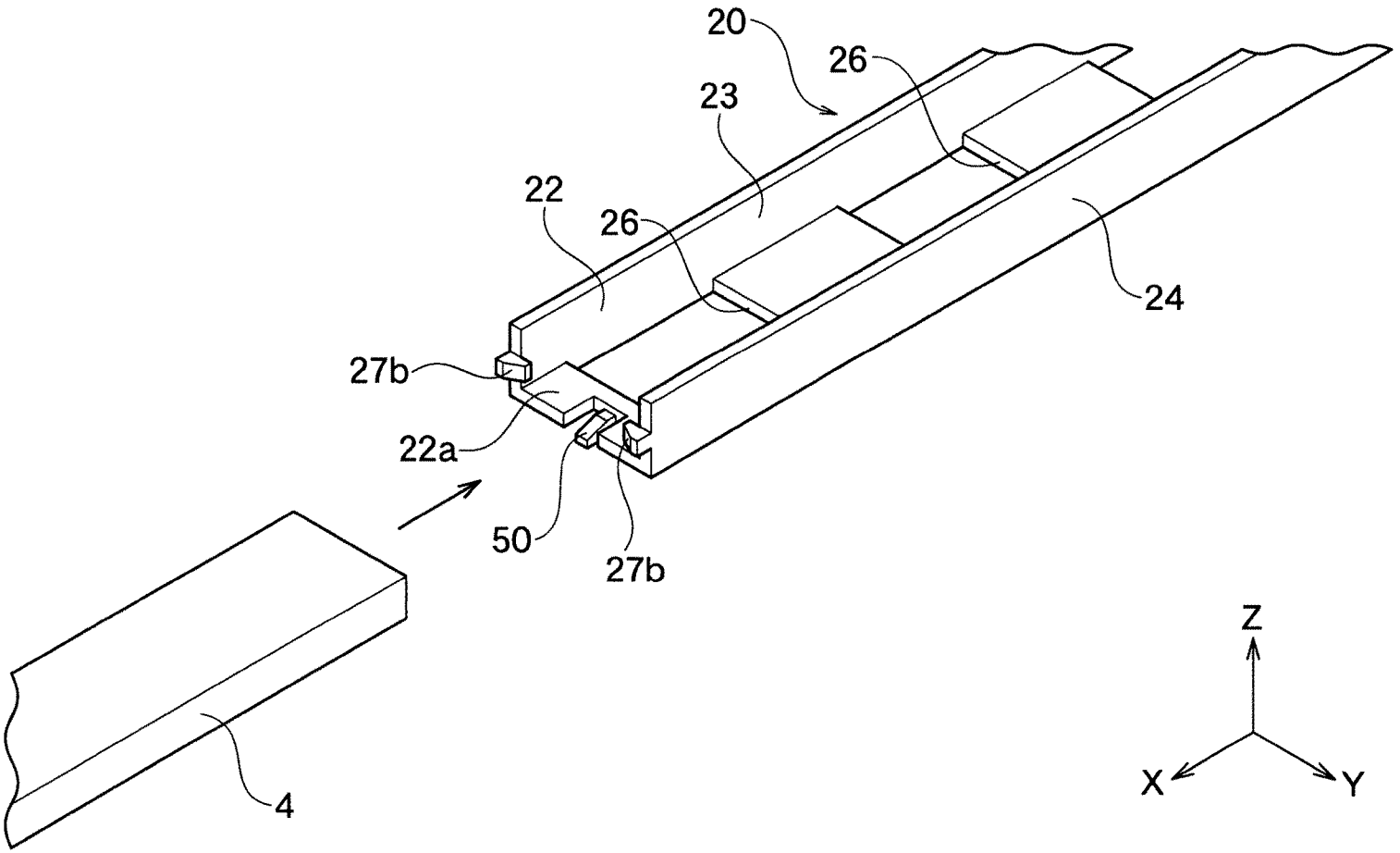
FIG. 8B is a disassembled perspective view of a main part showing a relation between a bobbin and a core member shown in FIG. 8A.

In the coil device 2D of the present embodiment, as shown in FIG. 8A, the core insertion port 22*a* may be provided with claw portions 27*b* preventing the core member 4 contained in the longitudinal concave portion 22 from coming out from the insertion port 22*a* in the X-axis direction. As shown in FIG. 8B, the claw portions 27*b* are integrally formed near the insertion port 22*a* of the outer wall 24 so that the core member 4 is elastically deformed to open the insertion port 22*a* when inserted from the core insertion port 22*a* of the bobbin 20. After the core member 4 is inserted from the insertion port 22*a* along the X-axis, the claw portions 27*b* restore their original shape due to elastic deformation, a part of the insertion port 22*a* is closed as shown in FIG. 8A, and the core member 4 is prevented from coming out from the insertion port 22*a* in the X-axis direction. Incidentally, FIG. 8B does not illustrate a coil portion wound around the bobbin 20.

In the present embodiment, the core member 4 can be effectively prevented from moving toward the bobbin 20 along the X-axis direction in a state before the potting resin 60 shown in FIG. 8A is filled in the housing concave portion 42 of the outer case 40.

Incidentally, the present invention is not limited to the above-mentioned embodiments, and may be variously changed within the scope of the present invention.

For example, the component case housed in the electronic component housing portion 70 may be formed integrally with the bobbin. The bottom part of the component case in the Z-axis direction may be provided with a leg in contact with the bottom inner surface of the outer case 40 (easily deformable member may be employed). The oblique leg 50 is not necessarily arranged near the component case housed in the electronic component housing portion 70. It is possible to form a space between the bottom surface of the bobbin 40 in the Z-axis direction and the bottom inner surface of the outer case 40 and reach a potting resin to the space only by forming the single oblique leg 50 on the end portion of the bobbin 20 located opposite to the electronic component housing portion 70 along the X-axis direction.

In the present invention, the shape of the easily deformable member is not limited to that of the above-mentioned embodiments. For example, the pressing piece 28 of arc shape in the above-mentioned embodiments may be formed as easily deformable member on the bottom outer surface 21 of the bobbin 20 or the bottom inner surface 41 of the outer case 40. The easily deformable member is not necessarily formed integrally with the bobbin 20 or the outer case 40, and may be formed separately.

In the above-mentioned embodiments, the easily deformable member is constituted by using various measures for the shape of the plate piece or the linear piece (inclining, bending etc.), but a bobbin 20 or an outer case 40 having a small strength (buckling strength, bending strength, compressive strength etc.) may be employed as easily deformable member.

The cross sectional shape (X-Z cross section) of the core member 4 is not limited to a flat rectangular shape being long in the Y-axis direction, and may be a regular quadrangle, another polygonal shape, a circular shape, or an elliptical shape.

NUMERICAL REFERENCES

2, 2A to 2D . . . coil device
4 . . . core member
10 . . . wire
12 . . . coil portion
20 . . . bobbin
21 . . . bottom outer surface
22 . . . longitudinal concave portion
22*a* . . . core insertion port
23 . . . side surface opening portion
24 . . . outer wall
25 . . . leg
26 . . . window portion
27*a* . . . caulking portion
27*b* . . . claw portion
28*a* . . . pressing piece (first pressing portion)
28*b* . . . pressing piece (second pressing portion)
28*c* . . . convex portion
40 . . . outer case
41 . . . bottom inner surface
42 . . . housing concave portion
44 . . . opening port
50 . . . oblique leg (easily deformable member)
52 . . . abutting member
60 . . . potting resin
60*a* . . . free interface
70 . . . electronic component housing portion

The invention claimed is:

1. A coil device comprising:
a core member extending in a longitudinal direction;
a bobbin with a longitudinal concave portion (1) having a side surface opening portion and (2) housing the core member;
a coil portion comprising a wire wound around the bobbin and the core member;
an outer case with a housing concave portion that houses an assembly of the bobbin, the core member, and the coil portion;
a potting resin between (1) the housing concave portion and (2) the bobbin and the coil portion; and
an easily deformable member arranged between an outer wall of the bobbin and a bottom wall of the housing concave portion;
wherein:
an opening port of the housing concave portion and the side surface opening portion are open in the same direction;
the easily deformable member is capable of being deformed before the bobbin and the outer case are deformed when the outer case receives an impact; and
a longitudinal elasticity of the easily deformable member is larger than that of the potting resin.

2. The coil device according to claim 1, wherein the easily deformable member is formed integrally with the bobbin.

3. The coil device according to claim 1, wherein the bobbin is provided with a first pressing portion protruding from a part of an inner surface of the bobbin toward the core member.

4. The coil device according to claim 2, wherein the bobbin is provided with a first pressing portion protruding from a part of an inner surface of the bobbin toward the core member.

5. The coil device according to claim 1, wherein the side surface opening portion is provided with a second pressing portion extending inwardly from the longitudinal concave portion and preventing positional displacement of the core member relative to the longitudinal concave portion.

6. The coil device according to claim 2, wherein the side surface opening portion is provided with a second pressing portion extending inwardly from the longitudinal concave portion and preventing positional displacement of the core member relative to the longitudinal concave portion.

7. The coil device according to claim 1, wherein the side surface opening portion is provided with a convex portion preventing the core member from abutting the coil portion.

8. The coil device according to claim 2, wherein the side surface opening portion is provided with a convex portion preventing the core member from abutting the coil portion.

9. The coil device according to claim 1, wherein an end of the bobbin in the longitudinal direction is provided with a core insertion port communicating with the longitudinal concave portion.

10. The coil device according to claim 2, wherein an end of the bobbin in the longitudinal direction is provided with a core insertion port communicating with the longitudinal concave portion.

11. The coil device according to claim 9, wherein the core insertion port is provided with one of a claw portion and a caulking portion preventing the core member from coming out of the longitudinal concave portion.

12. The coil device according to claim 10, wherein the core insertion port is provided with one of a claw portion and a caulking portion preventing the core member from coming out of the longitudinal concave portion.

13. The coil device according to claim 1, wherein the longitudinal elasticity of the easily deformable member is 1000 to 20000 MPa, and the longitudinal elasticity of the potting resin is 0.1 to 100 MPa.

14. The coil device according to claim 2, wherein the longitudinal elasticity of the easily deformable member is 1000 to 20000 MPa, and the longitudinal elasticity of the potting resin is 0.1 to 100 MPa.

15. A coil device comprising:
a core member extending in a longitudinal direction;
a bobbin with a longitudinal concave portion (1) having a side surface opening portion and (2) housing the core member;
a coil portion comprising a wire wound around the bobbin and the core member;
an outer case with a housing concave portion that houses an assembly of the bobbin, the core member and the coil portion; and
a potting resin between (1) the housing concave portion and (2) the bobbin and the coil portion;

wherein:

an opening port of the housing concave portion and the side surface opening portion are open in the same direction; and the bobbin is provided with a first pressing portion protruding from a part of an inner surface of the bobbin toward the core member.

16. A coil device comprising:

a core member extending in a longitudinal direction;

a bobbin with a longitudinal concave portion (1) having a side surface opening portion and (2) housing the core member;

a coil portion comprising a wire wound around the bobbin and the core member;

an outer case with a housing concave portion that houses an assembly of the bobbin, the core member and the coil portion; and a potting resin between (1) the housing concave portion and (2) the bobbin and the coil portion;

wherein:

an opening port of the housing concave portion and the side surface opening portion are open in the same direction; and the side surface opening portion is provided with a convex portion preventing the core member from abutting the coil portion.

* * * * *